US010604995B2

(12) United States Patent
Kang

(10) Patent No.: US 10,604,995 B2
(45) Date of Patent: Mar. 31, 2020

(54) SEALING DOOR AND METHOD OF FORMING CHANNEL

(71) Applicant: SEJONG PHARMATECH CO., LTD., Incheon (KR)

(72) Inventor: Young Jae Kang, Incheon (KR)

(73) Assignee: SEJONG PHARMATECH CO., LTD., Incheon (KR)

( * ) Notice: Subject to any disclaimer, the term of this patent is extended or adjusted under 35 U.S.C. 154(b) by 104 days.

(21) Appl. No.: 15/570,107

(22) PCT Filed: Jun. 23, 2017

(86) PCT No.: PCT/KR2017/006647
§ 371 (c)(1),
(2) Date: Oct. 27, 2017

(87) PCT Pub. No.: WO2018/235977
PCT Pub. Date: Dec. 27, 2018

(65) Prior Publication Data

US 2018/0371829 A1 Dec. 27, 2018

(30) Foreign Application Priority Data

Jun. 22, 2017 (KR) ..... 10-2017-0078885

(51) Int. Cl.
*E06B 7/18* (2006.01)
*E06B 7/23* (2006.01)
*B30B 11/08* (2006.01)

(52) U.S. Cl.
CPC ..... *E06B 7/2318* (2013.01); *B30B 11/08* (2013.01)

(58) Field of Classification Search
CPC ..... E06B 7/2318; E06B 5/12; B30B 11/08
USPC ..... 49/477.1
See application file for complete search history.

(56) References Cited

U.S. PATENT DOCUMENTS 2,757,225 A * 7/1956 Dunn ..... E06B 5/18 174/364
3,100,918 A * 8/1963 Coverley ..... E06B 7/2318 49/477.1
3,352,446 A * 11/1967 Anderson ..... F16J 13/02 220/232
3,507,974 A * 4/1970 Roster ..... H05K 9/0015 174/367
3,514,115 A * 5/1970 Gallo ..... G21C 13/028 376/206

(Continued)

FOREIGN PATENT DOCUMENTS

EP 1482122 A1 12/2004
KR 100629928 B1 10/2006
KR 101499387 B1 3/2015

OTHER PUBLICATIONS

International Search Report dated Mar. 20, 2018, for the corresponding PCT Application No. PCT/KR2017/006647, total 3 pages.

*Primary Examiner* — Jerry E Redman
(74) *Attorney, Agent, or Firm* — Lucas & Mercanti, LLP

(57) ABSTRACT

The present invention provides a sealing door that includes: a first seal disposed on at least a first surface of the door to increase the sealing ability of the door that opens and closes an entry; a second seal disposed along the first seal at a predetermined distance from the first seal; and a channel formed in the door to inject fluid into the first seal and the second seal.

3 Claims, 6 Drawing Sheets

(56) References Cited

U.S. PATENT DOCUMENTS 3,518,355 A * 6/1970 Luce ..... H05K 9/0015 174/365
3,678,624 A * 7/1972 Bicicchi ..... E06B 7/2318 49/477.1
3,747,275 A * 7/1973 May ..... B61D 19/001 49/477.1
3,796,010 A * 3/1974 Carlson ..... E06B 7/2318 49/477.1
3,819,479 A * 6/1974 Jacquelin ..... G21C 13/073 376/206
3,857,199 A * 12/1974 Frach ..... E06B 3/9682 49/477.1
4,114,901 A * 9/1978 Pot ..... B65D 90/587 277/646
4,177,353 A * 12/1979 McCormack ..... H05K 9/0015 174/374
4,335,075 A * 6/1982 Kackos ..... F16J 15/46 220/232
4,355,000 A * 10/1982 Lumelleau ..... E06B 7/2318 376/205
4,370,831 A * 2/1983 Hamilton ..... H05K 9/0015 174/375
4,371,175 A * 2/1983 Van Dyk, Jr. ..... E06B 7/2318 174/357
4,399,317 A * 8/1983 Van Dyk, Jr. ..... F16J 15/46 174/356
4,427,378 A * 1/1984 Bowers ..... F26B 25/12 110/173 R
4,582,451 A * 4/1986 Hollander, Jr. ..... E02B 7/54 251/328
4,665,653 A * 5/1987 Franz ..... B63B 19/26 114/201 A
4,722,151 A * 2/1988 Westwell ..... E06B 7/2318 49/14
4,770,235 A * 9/1988 Rogers, Jr. ..... F22B 37/222 138/93
4,820,384 A * 4/1989 Pechacek ..... B01J 3/03 110/177
4,932,441 A * 6/1990 Corey ..... F16L 55/134 138/93
5,046,886 A * 9/1991 Muir ..... E01F 13/02 404/25
5,460,462 A * 10/1995 Regan ..... E02B 3/104 405/96
6,099,712 A * 8/2000 Ritzdorf ..... C25D 17/001 204/275.1
6,161,838 A * 12/2000 Balsells ..... F16J 15/3216 277/511
6,231,502 B1 * 5/2001 McCarty ..... A61F 5/41 600/38
6,698,439 B2 * 3/2004 Kamikawa ..... H01L 21/67028 134/138
8,021,488 B2 * 9/2011 Tanaka ..... C23C 16/4409 118/733
8,206,660 B2 * 6/2012 Buczynski ..... A61L 2/26 422/296
8,595,983 B2 * 12/2013 Gaviglia ..... E06B 7/2318 49/477.1
9,376,778 B2 * 6/2016 Knezevich ..... E04H 9/145
10,184,564 B2 * 1/2019 Balsells ..... F16J 15/3212
10,249,525 B2 * 4/2019 Schaller ..... C23C 16/45565
2002/0153664 A1 * 10/2002 Schroeder ..... F16J 15/002 277/551
2005/0212218 A1 * 9/2005 Balsells ..... F16J 1/008 277/434
2008/0289258 A1 * 11/2008 Gasperini ..... B65B 65/00 49/477.1
2010/0237566 A1 * 9/2010 Balsells ..... F16J 15/166 277/550
2011/0037234 A1 * 2/2011 Balsells ..... F16J 15/3212 277/562
2011/0061301 A1 * 3/2011 Gaviglia ..... E06B 5/18 49/70
2011/0126472 A1 * 6/2011 Harrison ..... B64G 1/22 49/477.1
2011/0258934 A1 * 10/2011 Gaviglia ..... E06B 7/2318 49/477.1
2012/0260579 A1 * 10/2012 DeMello ..... E06B 7/2309 49/477.1
2012/0317887 A1 * 12/2012 Duelli ..... F16J 15/46 49/477.1
2013/0043661 A1 * 2/2013 Binder ..... F16J 15/322 277/554
2014/0265139 A1 * 9/2014 Dilmaghanian ..... F16J 15/3208 277/309
2014/0360100 A1 * 12/2014 Krug ..... E06B 7/22 49/477.1
2015/0061227 A1 * 3/2015 Rastegar ..... F16J 15/3212 277/309
2017/0172018 A1 * 6/2017 Dilmaghanian ..... H05K 9/0016

* cited by examiner

Cross Section A-A

SEALING DOOR AND METHOD OF FORMING CHANNEL

CROSS-REFERENCE TO RELATED APPLICATIONS

This application is a U.S. national stage of PCT/KR2017/006647, filed Jun. 23, 2017 which claims the priority from Korean Patent Application No 10-2017-0078885, filed Jun. 22, 2017, the contents of each of which are incorporated herein by reference.

TECHNICAL FIELD

The present invention relates to a sealing door and a method of forming a channel and, more particularly, to a sealing door that can more efficiently hermetically seal an entry of a body and allows for easy injection of a seal, and a method of forming a channel.

BACKGROUND ART

Recently, with development of civilization, rotary tablet presses for high-speed mass production have been developed and used to produce tablets of predetermined sizes from raw powders having various components in order to enable simply carrying and keeping of medicines and improve the effect by maximizing the actual amount of raw powder used.

These rotary tablet presses include top and bottom rotary tables disposed in the body to rotate at a high speed, a plurality of top and bottom punches arranged along the edges of the rotary tables to respectively correspond to each other cavities formed on the bottom table to produce tablets, top and bottom track rails moving up and down the top and bottom punches in a predetermined section for actual pressing, top and bottom rollers pressing powder, and a raw powder supplier disposed at a side to supply raw powder.

Accordingly, the top and bottom rotary tables and the top and bottom punches belonging to the rotary tables are rotated in the same direction by a driving unit such as a motor. Further, in this process, the raw powder supplier at a side continuously supplies raw powder into the cavities on the bottom table and the top and bottom punches press the raw powder in the cavities while simultaneously moving up and down in the section where the top and bottom rollers are positioned, whereby it is possible to produce tablets in a predetermined shape.

The body of the rotary tablet presses is equipped with a door so that it is possible to not only protect the internal work environment, but check the work status, clean the inside, and check and repair parts. The door has seals for increasing a sealing ability for the internal work environment of the body.

Air injection type seals are formed along the edge of the door and are expanded by air that is injected thereinto when the door is closed, thereby improving the sealing ability of the body. Further, when the door is opened, the injected air is discharged and the seals contract, so the door can be easily opened.

However, the doors of the tablet presses of the related art are hinged to the upper end of the entrance of the body, so when the doors are turned up to open, air is discharged and the seals contract, so the seals are easily pulled out from fitting grooves on the doors.

Further, an air injection hose for injecting air is connected to the air injection type seals of the related art and the air injection type seals are disposed on the inner side of the doors, that is, the side of the doors, which faces the entry of the body, so it is very difficult to connect the air injection hose.

Accordingly, it is strongly required to improve the structure of the doors in order to easily inject air into the air injection type seals.

DISCLOSURE

Technical Problem

The present invention has been made in an effort to solve the problems in the related art and an object of the present invention is to provide a sealing door for opening/closing an entry of a body, in which a channel for injecting fluid is formed in the door, the channel and a seal is connected through a nozzle, and a fluid injection hose is connected to the inlet of the channel so that fluid injected through the fluid injection hose is injected into the seal through the channel, thereby improving the sealing ability of the door and easily injecting fluid into the seal.

Another object of the present invention is to provide a sealing door of which the sealing ability is improved by a double structure of a first seal and a second seal and in which the first seal is disposed along the edge of a side of the door to come in contact with the outer side of the entry of a body, and the second seal is disposed on the outer side of a stepped frame positioned inside the first seal and forming a predetermined angle with the first seal to come in close contact with the inner side of the entry of the body, thereby largely improving the sealing ability of the door.

Another object of the present invention is to provide a sealing door having a structure that fixes a seal such that the seal is not easily pulled out of a fitting groove when the door is opened.

Technical Solution

In order to achieve the objects, a sealing door according to an aspect of the present invention has a channel therein to inject fluid into a seal for increasing hermetic sealing of the door opening and closing an entry.

A sealing door according to another aspect of the present invention includes: a first seal disposed at least on a first surface of the door to increase a sealing ability of the door that opens and closes an entry; and a second seal disposed on a stepped frame protruding or recessed on the first surface of the door and positioned at a side of the first seal.

The first seal and the second seal may form an angle of at least 80° to 90°.

The first seal may be fitted in a first fitting groove formed on the door and a groove for fixing the first seal may be formed in the first fitting groove, and a projection inserted and locked in the groove may be formed on the first seal.

A sealing door according to another aspect of the present invention includes: a first seal disposed on at least a first surface of the door to increase a sealing ability of the door that opens and closes an entry; a second seal disposed along the first seal at a predetermined distance from the first seal; and a channel formed in the door to inject fluid into the first seal and the second seal.

The second seal may be disposed on a stepped frame protruding or recessed on a first surface of the door and may form an angle of at least 80° to 90° with the first seal.

The channel may include a first channel communicating with the outside and connected to the first seal and a second channel diverging from the first channel and connected to the second seal, so fluid is simultaneously injected into the first seal and the second seal.

A first nozzle may be disposed in the first seal to guide intake fluid by being inserted in the first channel, a second nozzle may be disposed in the second seal to guide intake fluid by being inserted in the second channel, and an O-ring for increasing force for coupling to the first channel and the second channel may be fitted on ends of the first nozzle and the second nozzle.

The first seal may be fitted in a first fitting groove formed on the door and a groove for fixing the first seal may be formed in the first fitting groove, and a projection inserted and locked in the groove may be formed on the first seal.

A method of forming a channel for injecting fluid into a channel in a sealing door according to another aspect of the present invention includes: forming a first channel in the sealing door to inject fluid into a first seal disposed on at least a first surface of the sealing door; forming a second channel in a stepped frame positioned at a side of the first seal and forming a predetermined angle with the first seal to inject fluid into a second seal disposed on the stepped frame; and bonding the stepped frame such that the first channel and the second channel are connected to each other.

In order to form the first channel, the method may further include: forming a main channel under a first fitting groove in which the first seal is fitted to communicate with the outside by drilling a side of the sealing door; forming a first diverging channel connected to the main channel by drilling a center of the first fitting groove; and forming a second diverging channel connected to the main channel by drilling the first surface of the sealing door to an end of the main channel.

In order to form the second channel, the method may further include: forming a first hole by drilling a center of a second fitting groove formed on an outer side of the stepped frame; and forming a second hole connected to the first hole by drilling a first surface, which corresponds to the second diverging channel, of the stepped frame.

Advantageous Effects

According to the present invention, since the channels for injecting fluid into the door that opens/closes the entry of the body are formed and fluid is injected into the seals through the channels, it is possible to easily control fluid that is injected into the seals.

Further, the hermetic sealing of the door is improved by the double structure of the first seal and the second seal and the door is configured such that the seals are not pulled out of the fitting grooves when the door is opened, so convenience in use can be improved.

Further, since the channels are formed such that fluid is simultaneously injected into the first seal and the second seal, it is possible to quickly control contraction and expansion of the first and second seals.

BEST MODE

Figure 1A:
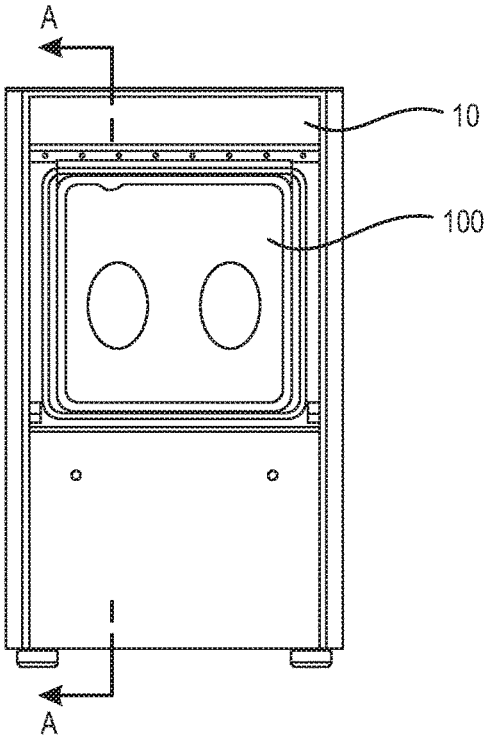
FIGS. 1*a* and 1*b* are conceptual views showing a sealing door of a tablet press according to an embodiment of the present invention.

The objects, characteristics, and other advantages of the present invention will be made clear by explaining preferred embodiments of the present invention with reference to the accompanying drawings. Hereinafter, a sealing door according to an embodiment of the present invention and a method of forming a channel will be described. Like reference numerals shown in the drawings indicate like components throughout the specification unless specifically stated.

The entire concept of a sealing door for a tablet press according to an embodiment will be described with reference to FIGS. 1 and 2, a double structure of first and second seals on the sealing door will be described with reference to FIG. 3, and the coupling relationship between the first seal and a first fitting groove will be described with reference to FIG. 4. Further, the coupling relationship between channels formed in the sealing door and the seals will be described with reference to FIG. 5 and a method of forming a channel will be described with reference to FIG. 6.

Figure 1B:
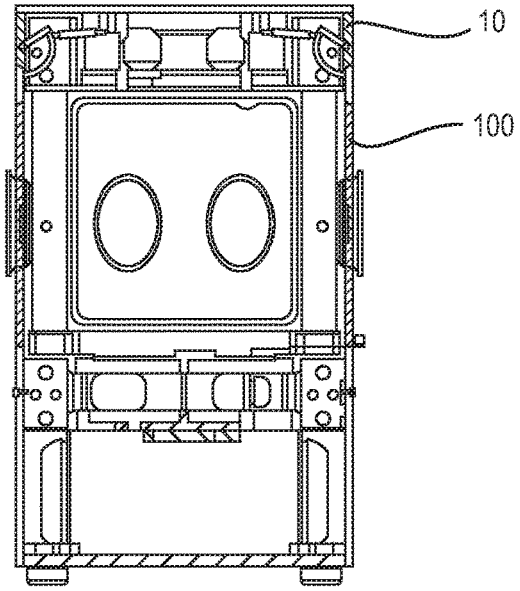
Figure 2A:
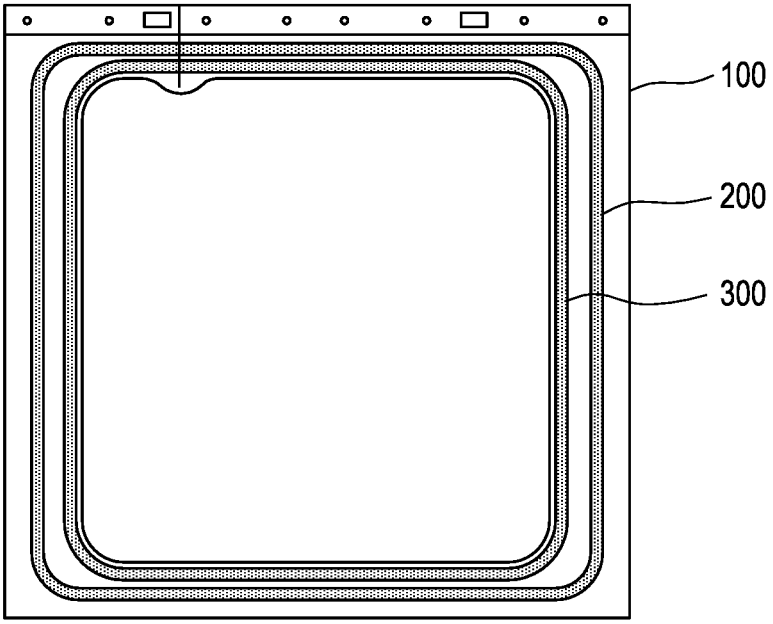
FIGS. 2*a* and 2*b* are enlarged views showing main parts of only the sealing door of the tablet press shown in FIGS. 1*a* and 1*b*.
Figure 2B:
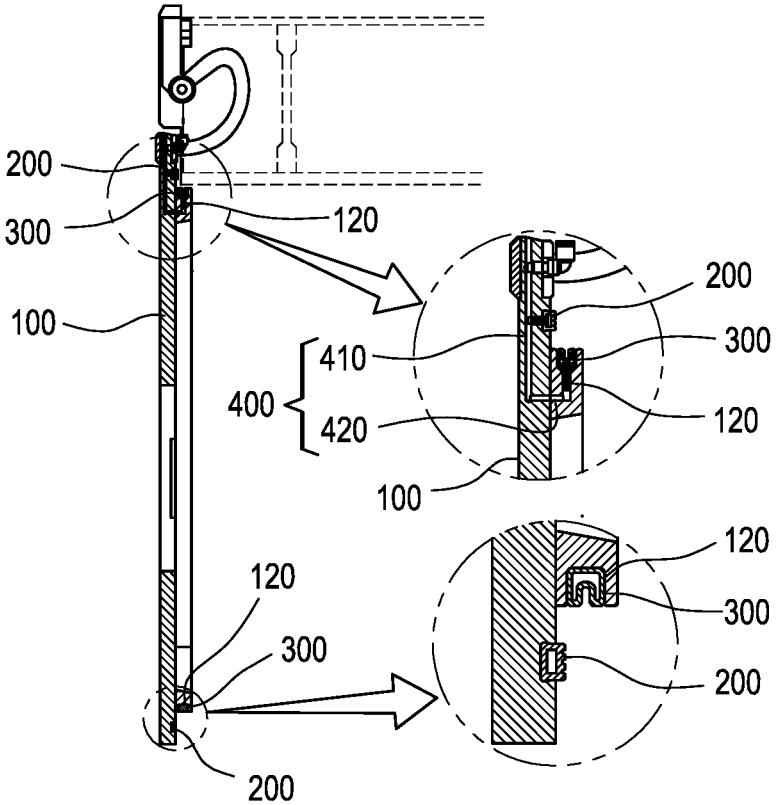

As shown in FIGS. 1 and 2, a sealing door 100 that opens/closes an entrance of a tablet press body 10 according to an embodiment of the present invention has a first seal 200 disposed along the edge of a first surface of the door 100 to improve a sealing ability of the door 100 and a second seal 300 disposed along the first seal 200 at a predetermined position inside from the first seal 200.

Figure 3:
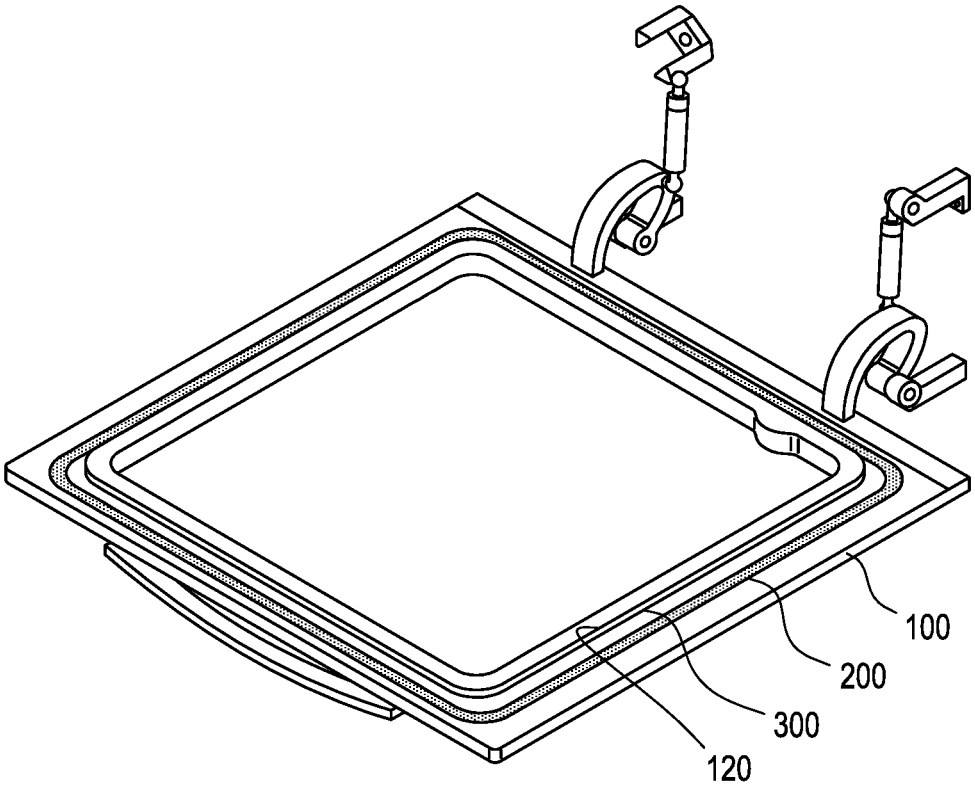
FIG. 3 is a perspective view showing a double structure of first and second seals on the sealing door according to an embodiment of the present invention.

Further, as shown in FIG. 3, the second seal 300 is disposed along the outer side of a stepped frame 120 protruding from the first surface of the door 100 to form an angle of 90° from the first seal 200. That is, the first seal 200 is disposed along the edge of the first surface of the door 100, so when the door 100 is closed, the first seal 200 comes in close contact with the outer side of the entry of the body 10 and the second seal 300 is inserted in the entry of the body 10 in contact with the inner side of the entry.

The first seal 200 is fitted in a first fitting groove 110 formed along the edge of the first surface of the door 100 and the second seal 300 is fitted in a second fitting groove 130 formed on the outer side of the stepped frame 120 protruding from the first surface of the door 100.

The first seal 200 and the second seal 300 are fluid injection type seals that are expanded by fluid that is injected thereinto when the door 100 is closed to increase hermetic sealing of the body 10 by improving the sealing ability of the door 100 and that contract by discharge of the injected fluid when the door 100 is opened so that the door 100 can be easily opened. The fluid includes gas and liquid that can expand the seals and air is exemplified in the following description.

Figure 4:
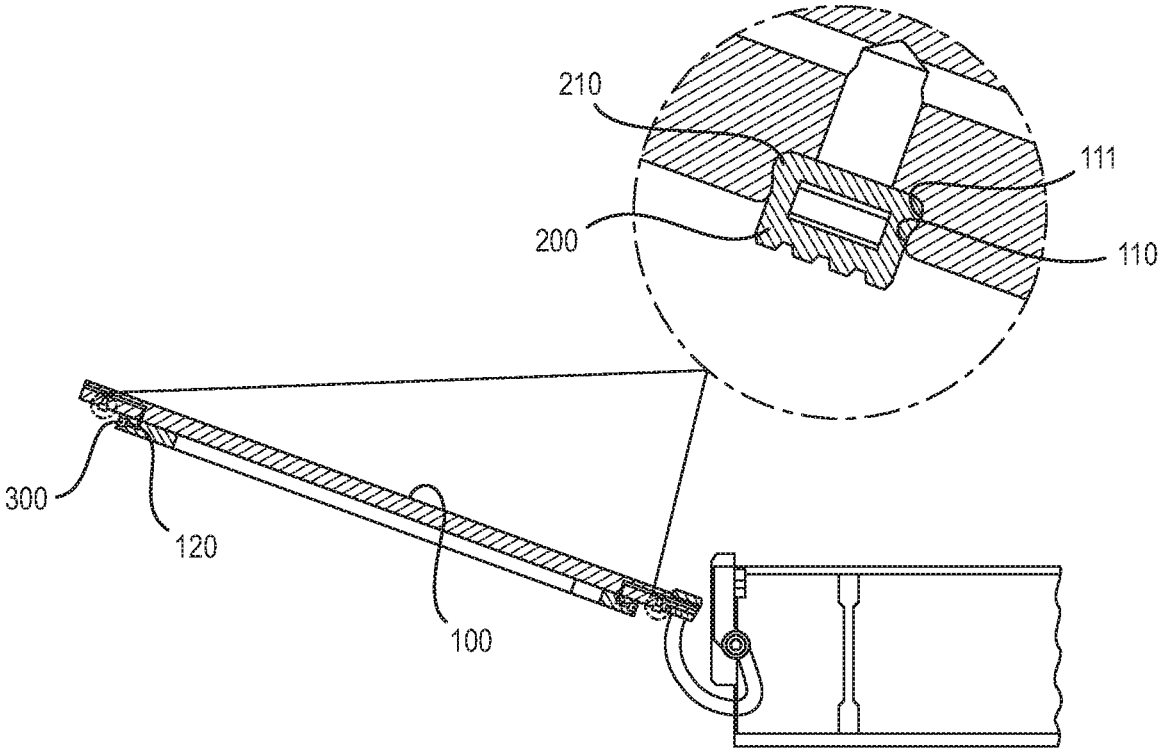
FIG. 4 is an enlarged view showing the coupling relationship between the first seal and a first fitting groove with the sealing door according to an embodiment of the present invention open.

As shown in FIG. 4, when the door 100 is opened and then turned up with the first and second seals 200 and 300 contracted, in terms of the structure, the second seal 300 fitted in the second fitting groove 130 on the stepped frame 120 is not easily pulled out of the second fitting groove 130, but the first seal 200 fitted in the first fitting groove 110 on the door 110 may be easily pulled out of the first fitting groove 110. In order to solve this problem, a groove 111 for fixing the first seal 200 is formed in the first fitting groove 110 and a projection 210 inserted and locked in the groove 111 is formed on the first seal 200 so that the projection 210 of the first seal is fitted and locked in the groove 111 of the first fitting groove, whereby the first sealing member 200 is not easily pulled out of the first fitting groove 110 even though the first door 100 is open.

Further, a channel 400 for injecting air into the first seal 200 and the second seal 300 is formed in the door 100.

The channel 400 is formed such that air can be simultaneously injected into the first seal 200 and the second seal 300. However, the present invention is not limited thereto and the channel 400 may be formed such that air can be separately injected into the first seal 200 and the second seal 300.

Figure 5:
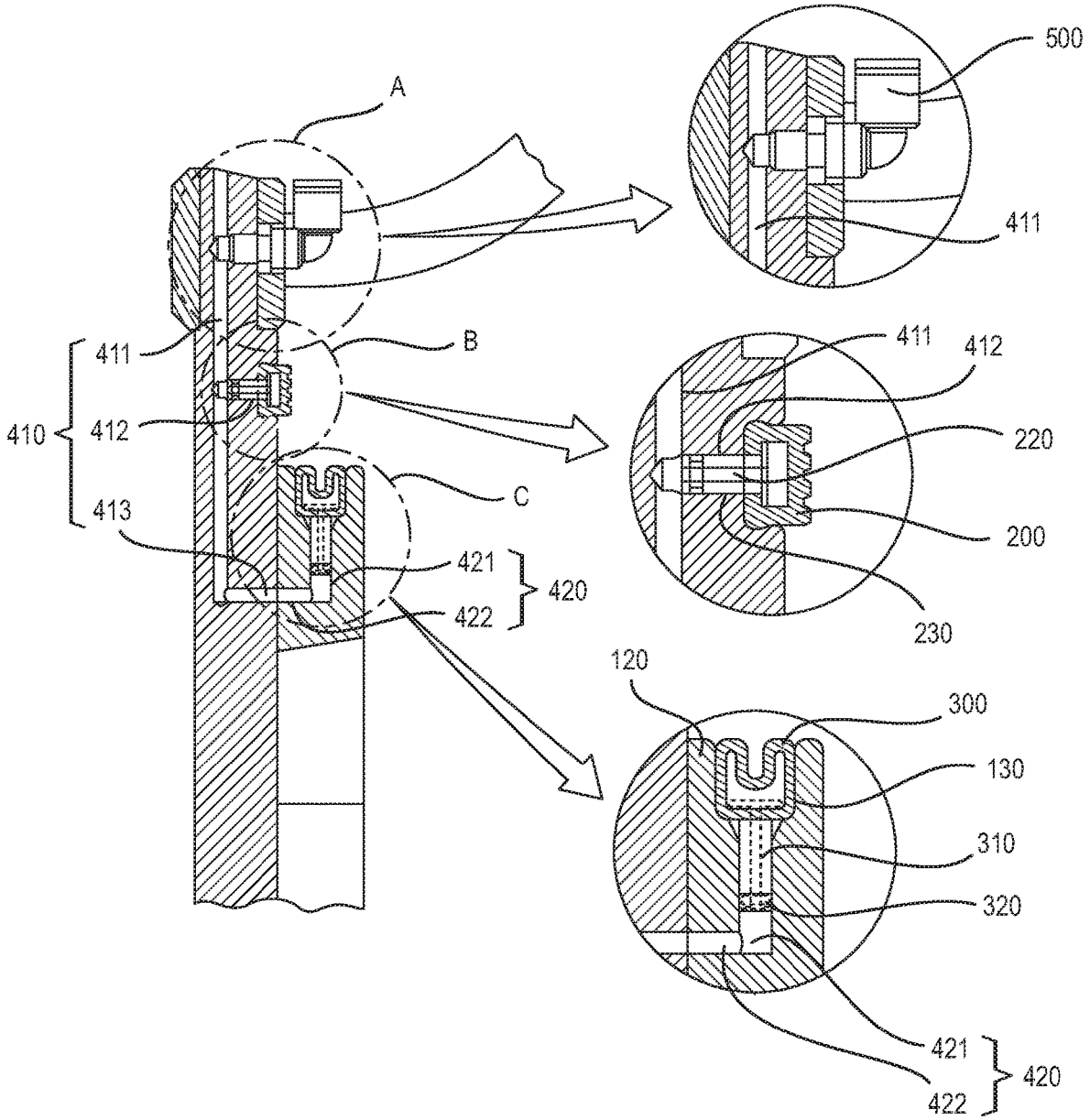
FIG. 5 is an enlarged view showing in detail channels and portions A, B, and C of the sealing door according to an embodiment of the present invention.

As shown in FIG. 5, the channel 400 is composed of a first channel 400 that communicates with the outside and is connected to the first seal 200 and a second channel 420 that diverges from the first channel 410 and is connected to the second seal 300, and an air (fluid) injection hose 500 for injecting air is connected to the inlet of the first channel 410.

Since the first seal 200 is fitted in the first fitting groove 110 formed along the edge of the first surface of the door and the second seal 300 is fitted in the second fitting groove 130 formed on the outer side of the stepped frame 120 protruding from the first surface of the door with an angle of 90° formed between the first seal 200 and the second seal 300, there is provided a method of forming the channel 400 so that air can be simultaneously injected into the first seal 200 and the second seal 300.

Figure 6:
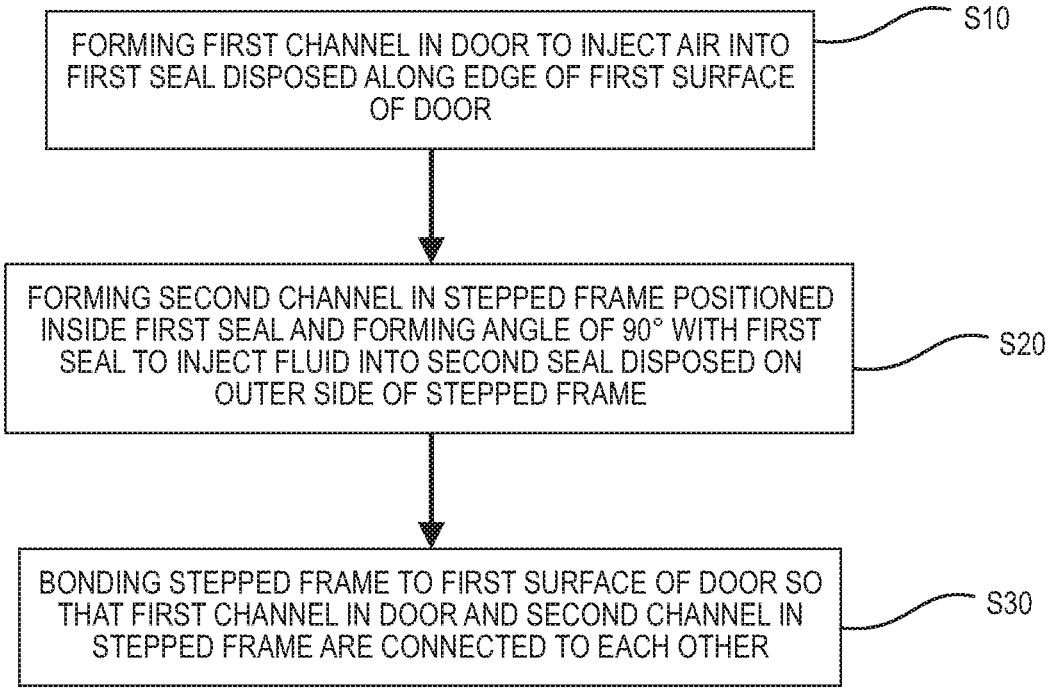
FIG. 6 is a flowchart showing a method of forming a channel in a sealing door according to an embodiment of the present invention.

The method of forming the channel 400, as shown in FIG. 6, forms first the first channel 410 in the door 100 so that air can be injected into the first seal 200 disposed along the edge of the first surface of the door 100. In detail, in order to form the first channel 410, a main channel 411 that communicates with the outside is formed under the first fitting groove 110 in which the first seal 200 is fitted by drilling a side of the door 100 and then a first diverging channel 412 that is connected to the main channel 411 is formed by drilling the center of the first fitting groove 110. Then, a second diverging channel 413 that is connected to the main channel 411 is formed by drilling the first surface of the door 100 to a second end of the main channel 411.

A separate injection channel for fitting the air (fluid) injection hose may be formed to communicate with a first end of the main channel, and since the air (fluid) injection hose is fitted in the injection channel to supply air, the inlet of the main channel is finished with acryl or SUS.

Next, the second channel 420 is formed in the stepped frame 120 to inject air into the second seal 300 positioned inside the first seal 200 and disposed on the outer side of the stepped frame 120 to form an angle of 90° from the first seal 200. In detail, in order to form the second channel 420, a first hole 421 is formed by drilling the center of the second fitting groove 130 formed on the outer side of the projective step 120 and then a second hole 422 that is perpendicularly connected to the first hole 421 is formed by drilling a first surface of the stepped frame 120 at a position corresponding to the second diverging channel 413 of the first channel 410 formed in the door 100.

Next, the stepped frame 120 is bonded to the first surface of the door 100 so that the first channel 410 in the door 100 and the second channel 420 in the stepped frame 120 are connected to each other. The bonding surface is finished with acryl or stainless steel.

The first channel 410 communicates with the first fitting groove 110 in which the first seal 200 is fitted and the second channel 420 communicates with the second fitting groove 130 in which the second seal 300 is fitted.

Further, a first nozzle 220 that is inserted in the first channel 410 to guide intake air is disposed in the first seal 200 that is fitted in the first fitting groove 110 and an O-ring 230 for increasing force for coupling to the first channel 410 is fitted on the end of the first nozzle 220.

Further, a second nozzle 310 that is inserted in the second channel 420 to guide intake air is disposed in the second seal 420 and an O-ring 320 for increasing force for coupling to the second channel 420 is fitted on the end of the second nozzle 320.

That is, the nozzle 220 disposed in the first seal 200 is forcibly fitted in the first channel 410, thereby connecting the first seal 200 and the first channel 410 to each other, and the nozzle 310 disposed in the second seal 300 is forcibly fitted in the second channel 420, thereby connecting the second seal 300 and the second channel 420 to each other.

Accordingly, air that is injected through the air (fluid) injection hose 500 connected to the inlet of the first channel 410 is injected into the first seal 200 through the first channel 410 and injected into the second seal 300 through the second channel 420 diverging from the first channel 410.

Meanwhile, an air regulator and a solenoid valve may be connected to the air (fluid) injection hose 500 to adjust pressure and control injection and discharge of air to be suitable for conditions of the first seal and the second seal. Further, a noise generator that generates noise when air is discharged may be provided to be able to check discharge of air and a controller for controlling the solenoid valve so that air is automatically discharged after the tablet press is stopped may be provided.

According to the present invention, since the channels for injecting air into the door that opens/closes the entry of the body are formed and air is injected into the seals through the channels, it is possible to easily control air that is injected into the seals.

Further, the sealing ability of the door is improved by the double structure of the first seal and the second seal and the door is configured such that the seals are not pulled out of the fitting grooves when the door is opened, so convenience in use can be improved.

Further, since the channels are formed such that air is simultaneously injected into the first seal and the second seal, it is possible to quickly control contraction and expansion of the first and second seals.

Although preferred embodiments of the present invention were described above, the present invention is not limited to the specific embodiments. That is, the present invention may be changed and modified in various ways by those skilled in the art without departing from the scope and spirit of the present invention described in the following claims, and all the appropriate changes and modifications should be construed as being included in the present invention as equivalents.

INDUSTRIAL APPLICABILITY

The present invention can be used in various doors.

The invention claimed is:

1. A sealing door comprising:

a first seal disposed at least on a first surface of the door to increase a sealing ability of the door, a second seal disposed on a stepped frame protruding or recessed on a first surface of the door and positioned at a side of the first seal, and a first channel connected to and for injecting fluid into the first seal and a second channel connected to and for injecting fluid into the second seal, wherein said first seal and said second seal form an angle of at least 80° to 90°, said second channel diverges from the first channel, and said first seal is fitted in a first fitting groove formed on the door and a groove for fixing said first seal is formed in the first fitting groove, and a projection inserted and locked in the groove is formed on said first seal.

2. The sealing door of claim 1, wherein a first nozzle is disposed in the first seal to guide intake fluid by being inserted in the first channel and a second nozzle is disposed in the second seal to guide intake fluid by being inserted in the second channel.

3. The sealing door of claim 2, wherein an O-ring for increasing force for coupling to the first channel and the second channel is fitted on ends of the first nozzle and the second nozzle.

* * * * *